United States Patent [19]

Brooks et al.

[11] 4,161,978

[45] Jul. 24, 1979

[54] INGOT CASTING

[75] Inventors: Carson L. Brooks; John W. Carson; Garland T. Culbreth, all of Richmond, Va.

[73] Assignee: Reynolds Metals Company, Richmond, Va.

[21] Appl. No.: 926,118

[22] Filed: Jul. 19, 1978

[51] Int. Cl.[2] ..... B22D 11/12; B22D 27/02

[52] U.S. Cl. ..... 164/49; 164/147; 164/251

[58] Field of Search ..... 164/82, 48, 49, 89, 164/146, 147, 250, 251, 418, 444

[56] References Cited

U.S. PATENT DOCUMENTS 3,605,865 9/1971 Getselev ..... 164/147

FOREIGN PATENT DOCUMENTS 2518903 1/1976 Fed. Rep. of Germany ..... 164/82

*Primary Examiner*—Othell M. Simpson
*Assistant Examiner*—K. Y. Lin
*Attorney, Agent, or Firm*—Glenn, Lyne, Girard, Clark & McDonald

[57] ABSTRACT

A system and method for continuous casting involves performing low-head casting within a highly electrically conductive shield/mold to block out an electromagnetic field that exists below the shield/mold. In this respect, the shield/mold and the electromagnetic field primarily cooperate to provide an environment in which low-head continuous casting can be safely carried out under controlled conditions. In one embodiment, the shield/mold is constructed of aluminum and a molten metal meniscus extends ½-to-1½ inches above the bottom of the shield/mold. The shield/mold is normally not in contact with the ingot being cast.

14 Claims, 2 Drawing Figures

INGOT CASTING

BACKGROUND OF THE INVENTION

This invention relates broadly to the art of continuous casting, and more particularly to a device which combines electromagnetic continuous casting and mold-type continuous casting.

The following discussion is especially directed to aluminum metals, as this invention is of particular advantage when used therewith. In this application, the term "aluminum metals" is intended to mean aluminum metal and alloys containing at least 50% aluminum.

The method now in greatest use in continuous casting of aluminum ingots is the direct chill or "DC" casting method disclosed by Ennor in U.S. Pat. No. 2,301,027 issued Nov. 3, 1942. This method employs a mold in the form of an open-ended sleeve or shell having a straight bore therethrough, with a surrounding sprayer which directs cooling fluid, such as a water spray, against the mold and also directly against the embryo ingot as it is withdrawn from the mold. The operation of the DC process forms a solidified surface around the ingot while it is within the mold, and then exposes that surface to the cooling water spray beneath the mold. The mold is relatively long so that a head, typically 2 to 4 inches, can be built up in the mold above the freeze zone. The mold, operated with a constant head, provides lateral support for the molten metal.

More recently, work has been done with electromagnetic casting systems, one of which is described in U.S. Pat. No. 3,605,865 to Getselev. This system has not yet been sufficiently developed to have extensive commercial use. Basically, in an electromagnetic casting system, molten metal is first introduced at a controlled rate onto a bottom block, or pan, located within a loop-shaped inductor to form an embryo ingot. The bottom block is lowered at a controlled rate with metal flow being controlled in accordance with this rate to form an ingot. The molten metal is confined laterally by electromagnetic forces generated by an alternating current in the inductor. The molten metal is thus formed into a shape similar to but smaller than the inductor. The emerging ingot is solidified in this shape by the application of a coolant such as water.

In most electromagnetic casting systems, there is an electromagnetic shield, or screen, located inside the inductor and arranged coaxially therewith. The shield is normally made of a non-magnetic, electrically conductive metal having a relatively high resistance such as stainless steel. The shield serves to attenuate the magnetic field of the inductor upwardly thereby lessening the electromagnetic forces restraining the ingot at the top as opposed to those at the lower edge of the shield. The advantages of such a shield are fully described in U.S. Pat. No. 3,605,865 to Getselev and the information in that patent is incorporated by reference herein. In this respect, the shield only attenuates the electromagnetic field, it does not eliminate it and Getselev points out in column 2, lines 31–42 in U.S. Pat. No. 3,605,865 that at frequencies of 1,000 to 2,000 Hz. the shield is made of a non-magnetic steel (such as stainless steel) having a high specific resistance, while at a frequency of 50 to 500 cycles per second, the shield can be made of aluminum or copper. The reason for these limitations is that above 500 cycles per second, aluminum and copper shields, because they are such good conductors, substantially block out the electromagnetic field within them so that the electromagnetic field within the shields would provide no restraining force for the molten metal.

Summarizing electromagnetic continuous casting systems, they are similar to the normal DC casting systems with the exception that they replace an aluminum mold of the DC system with an inductor and shield for creating an upwardly attenuated electromagnetic field to support the column of molten metal.

Still a third type of prior-art continuous casting that is pertinent to this invention is "low-head" continuous casting. Low-head continuous casting has been accomplished in the past, however, it is not widely used commercially because it is too difficult to start and control.

Low-head casting is basically performed without the aid of a mold or an electromagnetic inductor to laterally restrain the molten metal; thus, the name, low-head casting. The concept involves balancing heat transfer with molten metal feed such that as surface tension of the molten-metal's meniscus forms an upper edge of an ingot the molten metal is frozen. In other words, the freeze zone of the ingot is very close to the bottom of the miniscus of the molten metal so that it is not necessary to provide an external force, such as a mold or an electromagnetic field, to hold the molten metal in position before it is frozen. Such molding requires a very critical balancing of heat transfer, lowering rate and molten-metal feed. A possible undesirable result of an improper balance is a metal spill, or explosion, which can be dangerous to operators. It is thought that this is a main reason that low-head continuous casting has not been commercially successful in the past. Thus, it is an object of this invention to provide a system for low-head casting which can be adequately started and controlled.

It is yet another object of this invention to provide a continuous casting system and method which produces relatively high-quality ingots, especially with respect to surface quality with high solidification rate of surface areas.

SUMMARY

According to principles of this invention, a highly-conductive shield/mold creates a casting zone immediately above an electromagnetic field which is substantially free of the electromagnetic field and in which low-heat casting is performed. The low-head casting is performed immediately above the lower edge of the shield/mold so that the electromagnetic field can control molten-metal bleed-off (particularly during starts) from the low-head casting. The shield/mold surrounds the ingot at the casting zone and is very close thereto so that it also functions as a mold momentarily as needed, to aid in controlling the molten metal.

BRIEF DESCRIPTION OF THE DRAWINGS

The foregoing and other objects, features, and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
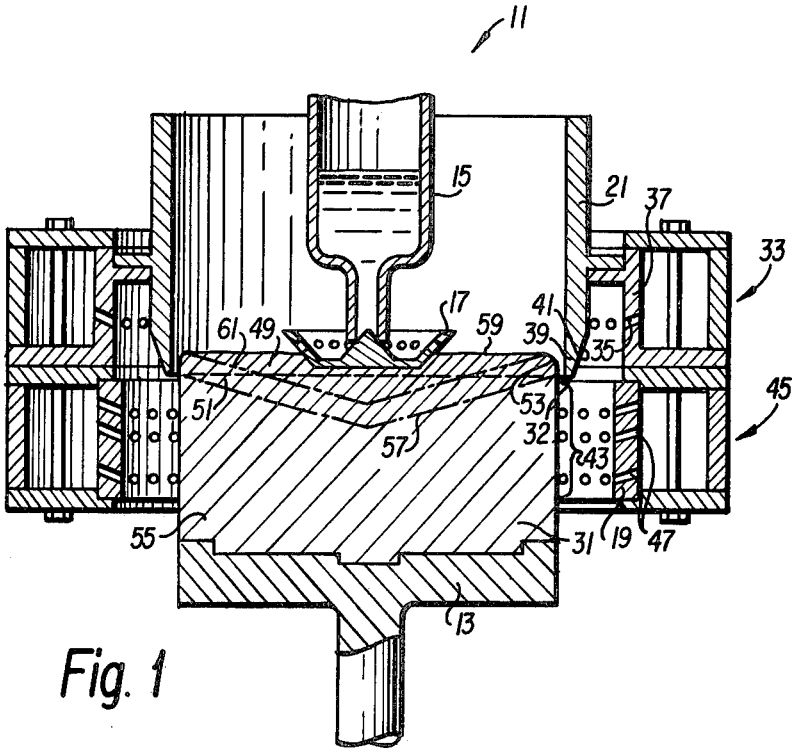
FIG. 1 is a cross-sectional view of a low-head casting system employing principles of this invention; and, FIG. 2 is an isometric view of the inductor of FIG. 1 including a schematic representation of an AC power source connected to the inductor.
Figure 2:
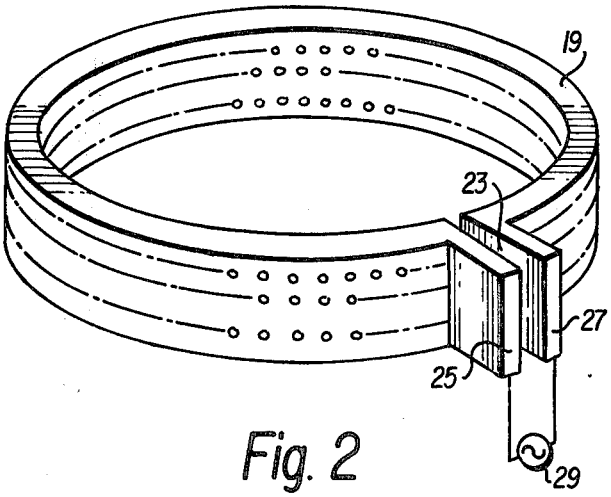

Referring to FIG. 1, a low-head continuous casting system 11 comprises a movable bottom block or pan 13, a supply spout 15 controlled by a float 17, a solid inductor 19, and a combination shield/mold 21. The solid inductor 19 is loop-shaped as is shown in more detail in FIG. 2, however, its ends are separated by a space 23. In this respect, the ends 25 and 27 are fed by an alternating power source 29 which provides an electrical signal having a frequency of between 2,200–3,3000 Hz.

The combination shield/mold 21 forms a completely closed loop at a position intermediate the solid inductor 19 and an ingot 31 being formed. The combination shield/mold 21, in the preferred embodiment, is formed of aluminum which is highly electrically conductive. The highly-conductive aluminum shield 21 substantially blocks out the electromagnetic field above its lower edge or tip 32. In the case of electromagnetic casting systems, the electromagnetic field is not blocked out above the lower edge 32 of the shield, but rather is only attenuated by a stainless steel shield and continues to affect molten metal positioned inside the shield.

The combination shield/mold 21 of this invention is approximately ¼-inch thick but it can be tapered at the lower edge 32 as shown.

A coolant box 33 has passages 35 through an inner wall 37 thereof. Coolant passing through the passages 35 is sprayed onto the backside of a lower tip portion 39 of the combination shield/mold 21 and flows down an outside tapered surface 41 of the combination shield-/mold to finally fall onto an impingement zone 43 of the ingot 31 just below the lower edge 32 of the combination shield/mold 21. The tapered surface 41 helps to get a close order application.

A second coolant box 45 is formed with the solid inductor 19 being the inner-most wall thereof. Coolant is sprayed from the second coolant box 45 onto the ingot 31 at the impingement zone 43 through passages 47 in the solid inductor 19. Such a system is sometimes known as a "water-through-inductor" coolant system.

In the range of frequencies in which the inductor 19 is energized by the alternating power source 29 (2,200–3,300 Hz.) the aluminum combination shield-/mold 21 acts as a complete shield to prevent virtually any electromagnetic field from operating on molten metal 49 located above the lower edge 32 of the shield-/mold 21 as is indicated in FIG. 1 by a first dashed line 51. It should be noted that the field-free zone includes a molten-metal meniscus upper edge 53 of the molten metal 49 such that the forming of this edge is not substantially influenced by an electromagnetic field.

It will be seen that a dashed line 57 (which represents the upper surface of a solidified ingot shell 55) intersects the molten-metal meniscus edge 53 at about the level of the lower edge 32 of the combination shield/mold 21. Actually, the portion of the ingot 31 between the dashed line 57 and a dashed line 61, is in a somewhat mushy or pasty state and the dashed line 57 marks the boundary between the mushy state and the true solid ingot portion where fluid flow is substantially no longer evident. Above the solid line 61, the ingot is totally fluid, but probably close to the liquidus temperature.

Describing first the steady-state operation of the low-head continuous casting system 11, fresh molten metal is supplied to the top of the molten metal 49 by the float 17 as the pan 13 moves downwardly. The impingement zone 43 is cooled firstly by water running down the outside of the shield/mold 21 which was sprayed onto the backside of the shield/mold 21 through the passages 35. However, water may also be sprayed through passages 47 and the inductor 19 onto the impingement zone 43. This cooling solidifies the molten metal 49 as the pan 13 moves downwardly. As to the meniscus edge 53, this does not ordinarily contact the combination shield-/mold 21 nor is it restrained by an electromagnetic field (since the shield/mold 21 blocks out the electromagnetic field created by the solid inductor 19). But rather, the meniscus upper edge 53 is created and maintained by surface tension and the balancing of heat transfer with the lowering rate and molten metal feed. Thus, as surface tension of the molten metal forms the meniscus of the upper edge 53 of the ingot, the ingot is first partially frozen and then fully frozen to form the ingot shell 55 having a desired size. In other words, as has been described above, the freeze zone of the ingot is very close to the lower part of the ingot meniscus upper edge 53 of the molten metal so that it is not necessary to provide an external force such as a mold or an electromagnetic field to hold the molten metal in position before it is frozen.

It will be appreciated that in this steady-state operating mode the combination shield/mold 21 serves as protection for equipment and personnel by enclosing within it the molten metal 49. In this regard, the inner surface of the combination shield/mold 21 is positioned so that light is visible between the ingot and shield-/mold 21. The distance between the shield/mold 21 and the ingot is probably less than 1/16 inch, although it has not been measured. Thus, the combination shield/mold 21 surrounds the molten metal 49 and when the molten metal momentarily exceeds its desired diameter, it, only momentarily, touches the combination shield/mold 21, is thereby frozen, and thereafter recedes from the combination shield/mold 21 back into its low-head continuous casting mode. Similarly, the electromagnetic field existing below the lower tip 32 of the shield/mold 21 tends to hold in molten metal when other conditions permit its bleeding out. Thus, both the combination shield/mold 21 and the solid inductor 19 tend to control and restrain molten metal that is being low-head continuously cast.

Next, describing the "start" of the low-head continuous casting system 11, this is accomplished in a first mode by relying on the combination shield/mold 21 to operate as a mold and hold the molten metal in until the steady-state condition described above is reached. With such a start, the pan 13 is positioned approximately at the lower edge 32 of the combination shield/mold 21 and the electromagnetic field and combination shield-/mold 21 retain the molten metal above the pan 13 until a start is achieved.

In another mode, the start is accomplished in the electromagnetic field created by the solid inductor 19 and then the casting zone of the ingot is moved upwardly into the combination shield/mold 21 where low-head continuous casting takes place as was described above. Thus, in this mode, the start is accomplished using electromagnetic continuous casting and the steady-state is carried out using low-head casting. In this mode, as well as in the other above mode, the electromagnetic field can be turned off after a start is achieved.

In both of these starting modes, the combination shield/mold 21 and the electromagnetic field help to contain and control the operation.

In the steady-state mode of operation, the head of molten metal (the distance extending approximately from the lower edge 32 of the shield/mold 21 to an upper surface 59 of the molten metal 49) is normally between ½ and 1½ inches into the shield/mold 21 as opposed to 2 to 4 inches for normal DC casting; however, it may be possible to operate this invention with a head as low as ⅜ inch.

The highly conductive combination shield/mold 21 creates an electromagnetic-field free zone in which the low-head continuous casting takes place.

Castings have been carried out in accordance with this invention to produce 13 inch round ingots. In this respect, remelted, degassed, 1235 scrap aluminum (grain refined), was introduced onto a bottom pan at an approximate temperature of 1,275 degrees fahrenheit. Water was sprayed from an upper, or primary, coolant box onto a combination shield/mold at an approximate rate of 16 gallons per minute and from a lower, or secondary, coolant box at an approximate rate of 15 gallons per minute, as a secondary spray, onto the ingot being cast. An inductor was energized with 28 to 33 volts, AC in the manner described above for energizing an inductor in this invention. The combination shield/mold was aluminum, a highly conductive material, in all cases. Casting speeds varied from 2¼ inches per minute to 4 inches per minute, with a normal variation at starts of from 3 to 3½ inches per minute. In all cases the inductor was energized during starts and the starts took place above the lower edge of the combination shield/mold as is described for the first "start" mode above. In one case, after the "start", the energy to the inductor was turned off for as long as four minutes when the casting speed was four inches per minute. In another case the energy was turned off for five minutes when the casting speed was 2¼ inches per minute. When the power was off during operation, there was no significant noticeable change from when it was on. The molten metal level was between ½ and 1½ inches above the lower edge 32 of the combination shield/mold, but in all cases it normally cleared the shield/mold.

These casting runs produced ingots having excellent surfaces which were relatively free of blemishes and comparable to those achieved by electromagnetic casting.

It will be appreciated by those skilled in the art that low-head ingots cast with the above-described system will need no scalping and offer improved rollability. The process is easier to operate and automate than normal electromagnetic casting. Further, the dimensions of ingots cast with this system are more stable than with electromagnetically cast ingots.

Also, level, no downspout, feeding should be possible with the low-head continuous casting system described herein.

Another advantage of the system described herein is that it is safe because the molten metal is surrounded by the combination shield/mold 21 and it is further restrained by an electromagnetic field created by the solid inductor 19. This adds a degree of safety over normal electromagnetic casting in that, should there be a power failure, the combination shield/mold 21 of this invention, continues to contain molten metal 49 and thereby prevents a spill out, whereas with a normal electromagnetic casting system a power failure automatically results in a spill out.

While the invention has been particularly shown and described with reference to a preferred embodiment, it will be understood by those skilled in the art that various changes in form and detail may be made therein without departing from the spirit and scope of the invention. For example, the exact location of the lower edge 32 of the combination shield/mold 21 does not have to be exactly at the upper edge of the inductor 19. In any event, however, there is no point in having the inductor 19 too high relative to the lower tip 32 of the shield/mold 21 because the shield/mold 21 substantially absorbs all energy in its area, thereby wasting power.

The embodiments of the invention in which an exclusive property or privilege are claimed are defined as follows:

1. A system for continuous casting an elongated ingot comprising:

a molten metal supply means for continuously supplying molten metal to a first end of said ingot at a casting zone;

a means for moving a second end of said ingot downwardly away from said supply means;

a means for cooling said molten metal at said casting zone close to said supply means to solidify said molten metal with low-head casting and thereby form said ingot;

an electromagnetic inductor positioned adjacent said casting zone, said electromagnetic inductor being energized by an alternating current source for producing an electromagnetic field at said ingot downstream of said casting zone;

an alternating power source with a frequency higher than 2,200 Hz; and, a metallic shield means surrounding said casting zone at a location intermediate said casting station and said inductor for blocking out virtually all of said electromagnetic field above the lower end of said shield means at said casting zone but allowing said electromagnetic field to exist at said ingot immediately below said casting zone.

2. A system for continuous casting as in claim 1 wherein said shield means is constructed of a highly conductive metal.

3. A system for continuous casting as in claim 2 wherein said highly conductive metal is aluminum.

4. A system for continuous casting as in claim 2 wherein said shield means has a loop shape and only extends downwardly to a level approximately at the top of the inductor.

5. A system as in claim 2 wherein said molten metal top surface is ½ to 1½ inches above the lower tip of said shield.

6. A system as in claim 2 wherein an inner surface of said shield is normally around 1/16 inch from the outer surface of an ingot being cast but can function as a mold when necessary.

7. A method for continuously casting an elongated ingot comprising the steps of:

depositing molten metal at a first end of an ingot with a supply means;

moving a second end of said ingot downwardly away from said supply means;

cooling said molten metal at a casting zone close to said first end to solidify said molten metal with low-head casting to form said ingot;

creating an electromagnetic field about said ingot downstream of said casting zone; and, virtually blocking out said electromagnetic field above the lower end of said shield means at said casting zone to allow said low-head casting to take place without virtually any influence from said electromagnetic field.

8. A method of continuously casting as in claim 7 wherein said step of creating an electromagnetic field about said ingot downstream of said casting zone includes the step of positioning a loop-shaped inductor about said ingot downstream of said casting zone, said loop-shaped inductor having an electrical signal applied thereto, and said step of substantially blocking out said electromagnetic field at said casting zone includes the step of positioning a loop-shaped highly electrically conductive metallic shield about said casting zone.

9. A method of continuously casting as in claim 8 wherein the rates of depositing molten metal and moving the second end of said ingot away from said supply means are maintained to achieve a ½ to 1½ inch head of molten metal above the lower tip of said shield.

10. A method of continuous casting as in claim 8 including the step of providing the electrical signal at an operating frequency in the range of 2,200–3,300 Hz.

11. A method of continuous casting as in claim 10 including the step of providing a loop-shaped aluminum shield about said casting zone.

12. A method of continuous casting as in claim 10 including the step of positioning said shield such that said shield only extends downwardly to the top of said inductor.

13. A method of continuous casting as in claim 8 including the step of positioning said shield about 1/16 inch from the outer surface of an ingot being cast, but can function as a mold where necessary.

14. A method of continuous casting as in claim 8 wherein is further included the step of controlling the rates of depositing molten metal, moving the second end of said ingot downwardly away from said supply means, and cooling said molten metal at a casting station to allow the molten metal to impinge upon the shield momentarily but then to control the said rates so as to return to low-head continuous casting.

* * * * *